US005769232A

United States Patent [19]

Cash et al.

[11] Patent Number: 5,769,232

[45] Date of Patent: Jun. 23, 1998

[54] INFLATABLE PROTECTIVE LINING SYSEM FOR CONTAINERS

[76] Inventors: Ronnie L. Cash; William Scott Sanders, both of 7214 SW. Drycreek, Andover, Kans. 67002

[21] Appl. No.: 699,097

[22] Filed: Aug. 16, 1996

[51] Int. Cl.[6] ..... B65D 81/14

[52] U.S. Cl. ..... 206/522; 206/594; 206/709; 383/3

[58] Field of Search ..... 206/522, 521, 206/594, 593, 709; 383/3

[56] References Cited

U.S. PATENT DOCUMENTS

| | | | |
|---|---|---|---|
| 3,398,501 | 8/1968 | Aninger | 206/522 X |
| 3,552,466 | 1/1971 | Fairchilds | 206/522 X |
| 3,807,622 | 4/1974 | Belcher et al. | 206/521 X |
| 3,889,743 | 6/1975 | Presnick | 206/522 X |
| 4,573,202 | 2/1986 | Lee | 383/3 |
| 4,872,558 | 10/1989 | Pharo . | |
| 4,874,093 | 10/1989 | Pharo . | |
| 4,918,904 | 4/1990 | Pharo . | |
| 5,180,060 | 1/1993 | Forti et al. | 206/522 |
| 5,263,587 | 11/1993 | Elkin et al. | 206/522 |
| 5,569,570 | 10/1996 | Jaszar | 206/522 X |
| 5,622,262 | 4/1997 | Sadow | 206/522 |

FOREIGN PATENT DOCUMENTS

| | | | |
|---|---|---|---|
| 2385606 | 12/1978 | France | 206/522 |
| 405330578 | 12/1993 | Japan | 206/522 |
| 848248 | 9/1960 | United Kingdom | 206/522 |

*Primary Examiner*—Bryon P. Gehman

*Attorney, Agent, or Firm*—Litman, McMahon & Brown, LLC

[57] ABSTRACT

An inflatable protective lining system for shipping containers includes a plurality of double wall inflatable chambers which are interconnected at their edges such that they can be folded to form an enclosure. An article to be protected is placed in the enclosure and the lining system is inserted into a shipping container. The chambers are then inflated via one or more elongate tubes to surround, cushion and protect the enclosed article within the container.

11 Claims, 3 Drawing Sheets

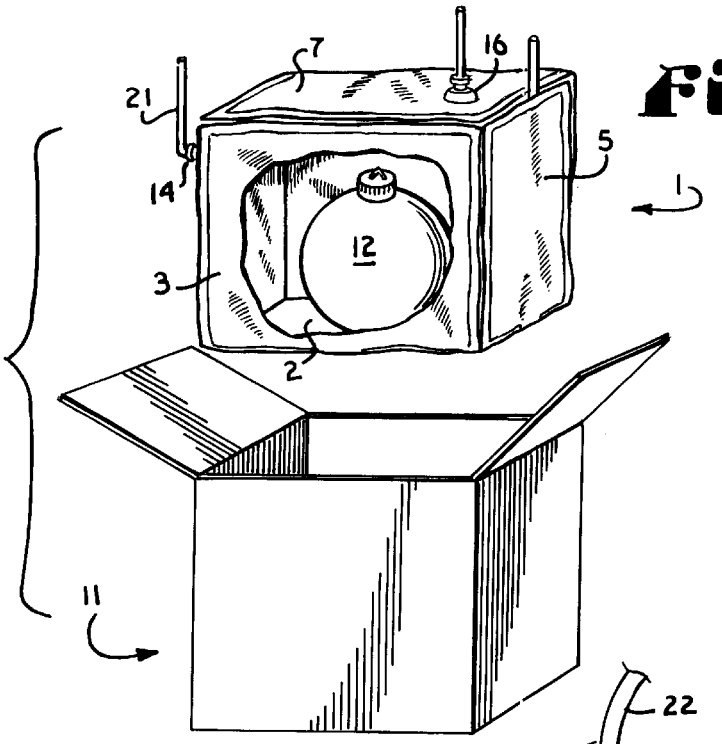
Fig.1.
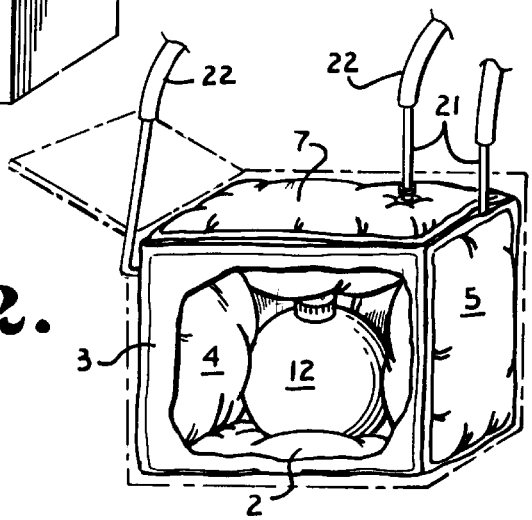
Fig.2.
Fig.3.
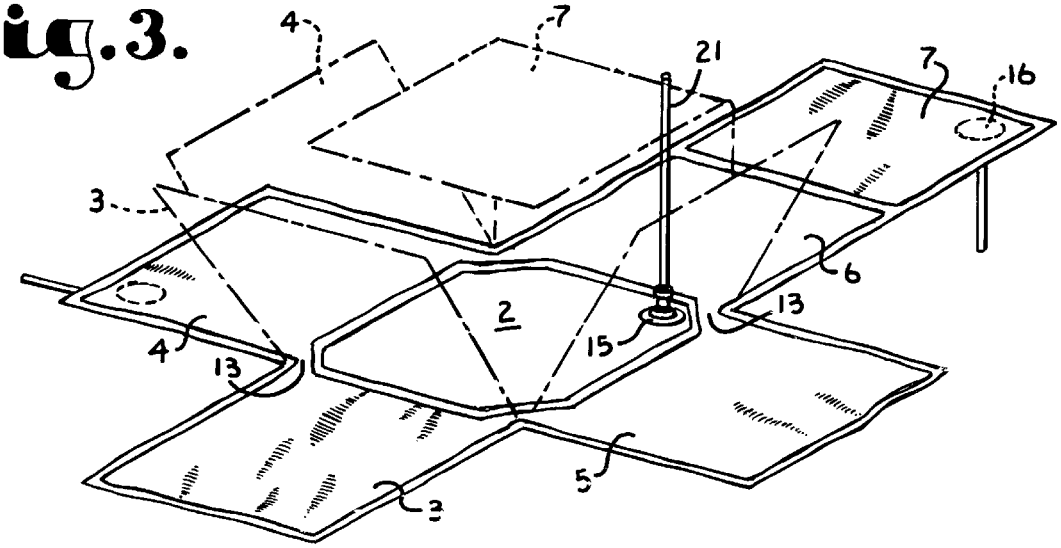

INFLATABLE PROTECTIVE LINING SYSEM FOR CONTAINERS

BACKGROUND OF THE INVENTION

1. Field of the Invention

The present invention relates generally to an inflatable protective lining system for containers, and, more particularly, to such a system in which a reusable plastic inflatable liner is inserted inside of a container, surrounding the contents thereof. Upon inflation, the liner surrounds, cradles, and protects the container contents.

2. Description of the Related Art

Secure shipping and handling of fragile and/or valuable articles has long presented a problem. Numerous different resilient packaging materials have been used as fillers to fill any container space not occupied by the article. Examples include shredded paper, styrofoam molded to the shape of the article, molded styrofoam "peanuts" and plastic "bubble wrap". All of these materials presents its own problem. In the case of shredded paper, with time and handling of the container, the paper tends to settle and compact, thereby losing much of its cushioning effect. Styrofoam molded to the shape of the article is very expensive and is typically used only for mass produced commodities such as electronic goods or the like. In the case of both molded styrofoam and styrofoam "peanuts", disposal is a problem as well. These materials are considered to be non-biodegradable and many communities limit or entirely outlaw the placement of such materials in their landfills and disposal facilities. Plastic bubble wraps are expensive and, although they are somewhat reusable, since they cannot be deflated, tend to take up a large amount of storage space between uses.

One example of an inflatable protective bag is that illustrated and described in the U.S. Pat. Nos. 4,872,558, 4,874,093 and 4,918,904 to Daniel Pharo. These patents describe an inflatable pillow or bag within which is placed an article to be shipped. Once inflated, the bag surrounds and protects the article which is held in a protected pocket or "bag within a bag". The Pharo protective bag, although apparently effective for its intended use, still exhibits a number of shortcomings. First, the protective bag is inflated from a single inlet such that a failure or puncture of any portion of the bag will deflate the entire bag. Furthermore, once inflated, the bag assumes a pillow-like shape which does not readily conform to the interior dimensions of any conventional outer container.

It is clear that a need exists for a reliable, efficient, economical inflatable protective lining system for protecting fragile and/or valuable items during shipping. Such a lining system should conform itself to the interior dimensions of typical shipping containers as well as the exterior dimensions of the articles being shipped. The lining system should allow an option of multiple, separately inflatable compartments such that a failure in one will not totally deflate the liner as well as an option for protecting a pair of smaller items within a single shipping container.

SUMMARY OF THE INVENTION

The present invention comprises an inflatable protective lining system for shipping containers. The lining system includes a plurality of double wall inflatable chambers which are interconnected at their edges such that they can be folded to form an enclosure. In a first embodiment, six rectangular chambers are interconnected such that they can be folded to form a rectangular enclosure. Four of the chambers form the sides of the enclosure and these side chambers are interconnected such that they are inflatable simultaneously. The remaining two chambers form the top and bottoms of the chamber and these are inflatable independently of each other and of the side chambers.

In a second embodiment, again, six rectangular chambers are interconnected such that they can be folded to form a rectangular enclosure. In this embodiment, all six chambers, as well as an optional seventh dividing chamber, are inflatable simultaneously via a single valve. In a variation, one or more of the chambers are connected to the other chambers via a one-way pressure sensitive valve such that the one or more chambers are filled to a certain pressure whereupon the one-way pressure sensitive valve closes automatically. The non-attached edges of each of the chambers can be provided with interlocking fasteners such as tongue and groove mating strips such that the chambers can be connected to each other to allow the lining system to be sealed and even sterilized.

OBJECTS AND ADVANTAGES OF THE INVENTION

The principle objects and advantages of the present invention include: providing a protective inflatable lining system for containers; providing such a lining system in which a plurality of double wall inflatable chambers are linked edge to edge such that can be folded to form an enclosure; providing such a lining system in which the inflatable chambers can be formed around an object to be protected and inserted into a shipping container in an deflated condition; providing such a lining system in which the chambers can be inflated after positioning within a container; providing such a lining system in which, in one embodiment, multiple valves are provided such that one or more of the interconnected chambers can be separately and independently inflated; providing such a lining system in which, in another embodiment, includes an additional panel which, when inflated, stands vertically to act as a separator between two articles to be shipped such that each article is independently cushioned and protected; providing such a lining system in which, in still another embodiment, interlocking fasteners are provided along the free sides of each panel such that the panels can be interlocked to form a sealed environment which is capable of being sterilized; providing such a lining system in which, in still another embodiment, a pressure sensitive check valve is provided between at least two of the chambers such that one of the two chambers is inflatable to a predetermined pressure at which the check valve will automatically close; and providing such a lining system which is economical to manufacture, efficient in operation, capable of repeated reuse and which is particularly well adapted for the proposed usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 1 is a perspective, exploded view of a shipping container shown in position to receive a first embodiment of an inflatable protective lining system in accordance with the present invention, with the lining system shown in an deflated state and with portions of one chamber broken away to illustrate the interior thereof.

FIG. 2 is a perspective view of the inflatable protective lining system of FIG. 1 placed within the container, with the container shown in phantom lines, and with the lining system inflated and with portions of one inflated chamber broken away to illustrate the interior thereof.

FIG. 3 is a perspective view of the inflatable protective lining system of FIG. 1, shown deflated, and with the individual chambers shown lying flat in solid lines and partially folded in phantom lines.

DETAILED DESCRIPTION OF THE PREFERRED EMBODIMENTS

I. Introduction and Environment

Figure 4:
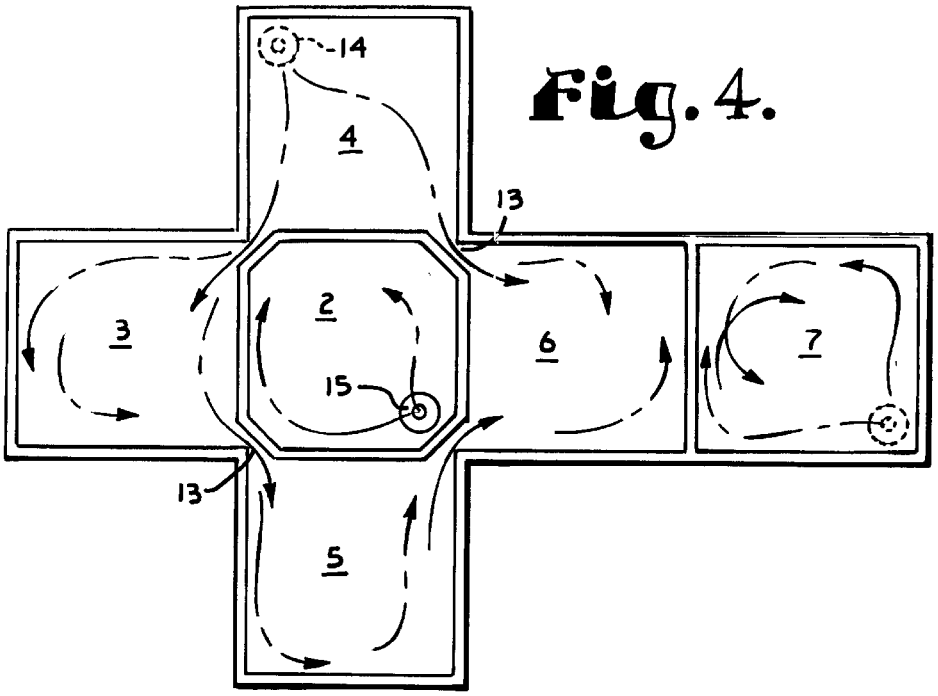
FIG. 4 is a top plan view of the inflatable protective lining system of FIG. 1, with the individual chambers shown lying flat and with arrows indicating how air flows during inflation.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Certain terminology will be used in the following description for convenience in reference only and will not be limiting. For example, the words "up", "down", "right" and "left" will refer to directions in the drawings to which reference is made. Said terminology will include the words specifically mentioned, derivatives thereof and words of a similar import.

Referring to the drawings in more detail, reference numeral 1 in FIGS. 1–4 generally designates a first embodiment of an inflatable protective lining system in accordance with the present invention. The lining system 1 includes a first or base rectangular, double wall inflatable chamber 2 which is connected on all four of its edges to respective double wall side inflatable chambers 3–6. The side chamber 6 is also connected along an edge opposite to the base chamber 2 to a double wall top chamber 7. The chambers 2–7 are thus interconnected in a fashion which allows them to be folded together to form an enclosure which surrounds an article to be protected and which can be placed in an exterior shipping container, such as the carton 11 in FIG. 1. FIGS. 1 and 2 illustrate, by way of example, a Christmas tree ornament 12, which could be a valuable keepsake item, positioned within the folded, deflated chambers 2–7.

Referring to FIGS. 2–4, in the lining system 1, the four side chambers 3–6 are interconnected together via a plurality of air passages 13 in a fashion which allows air to flow therebetween which air is introduced via a first one-way valve 14. The bottom chamber 2 and the top chamber 7 are isolated from the side chambers 3–6 and each includes a dedicated one-way valve 15 and 16, respectively. Each of the valves 14–16 has attached thereto a respective one of a plurality of elongate tubes 21, which tubes 21 extend upward and out of the carton 11 when the lining system 1 is inserted therein, as illustrated in FIG. 1. As shown in FIG. 2, once the lining system 1 is positioned within the carton 11, the side chambers 3–6, and the base and top chambers 2 and 7, respectively, are inflated via an air source, here indicated as three pneumatic hoses 22. As they are inflated, the chambers 2–7 push inward toward the ornament 12, thus cushioning the ornament 12 on all sides. The tubes 21 can be removable, or, alternatively they can incorporate pinch valves and can be folded downward within the carton 11 once the chambers 2–7 are sufficiently inflated. The separate valves 14–16 allow the base chamber 2 and the top chamber 7 to be inflated to different pressures than the side chambers 3–6, thus allowing the lining system 1 to accommodate objects of varying shapes and sizes. The elongate tubes 21 can be color coded with different colors representing the base chamber 2, the side chambers 3–6 and the top chamber 7, respectively.

Figure 5:
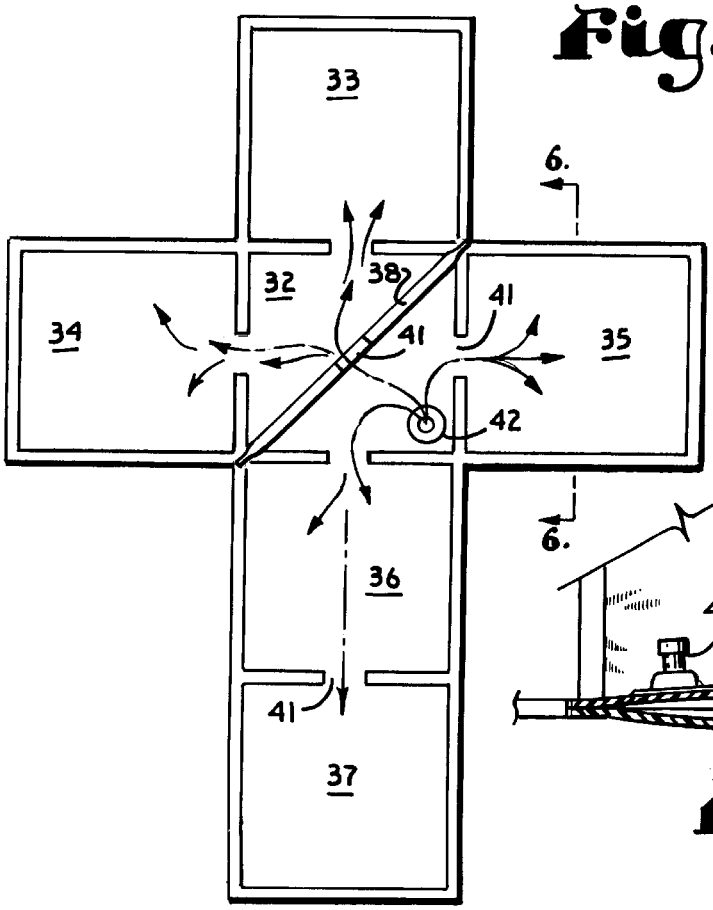
FIG. 5 is a top plan view of a second embodiment of inflatable protective lining system including an upstanding dividing chamber, again with arrows indicating the flow of air during inflation.
Figure 6:
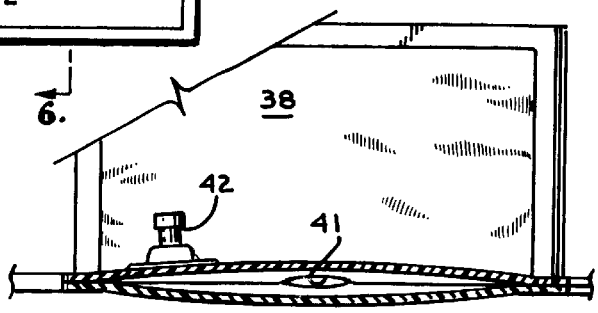
FIG. 6 is a cross sectional view of the inflatable protective lining system of FIG. 5, taken along line 6—6 of FIG. 5, and showing a portion of the upstanding chamber.

A second embodiment of the inventive inflatable protective lining system is illustrated in FIGS. 5 and 6, and is generally indicated as 31. The lining system 31, as in the system 1, includes a base chamber 32, four side chambers 33–36 and a top chamber 37. The lining system 31 also includes a vertical separating chamber 38 which has a lower edge connected to an upper surface of the base chamber 32. In the lining system 31, each of the chambers 32–38 are commonly interconnected via respective air passages 41 such that the entire lining system 31 can be simultaneously inflated via a single one-way valve 42 and elongate tube 21 (not shown).

Referring to FIGS. 5 and 6, when the lining system 31 is folded and placed in a container (not shown), the separating chamber 38 extends diagonally across the interior space of the folded lining system 1. This allows two, smaller items (not shown) to be protected and shipped in the same container since the items are protected from the outside via the inflated chambers 32–37 and are protected from each other via the inflated separating chamber 38. Although the separating chamber 38 is shown as being diagonal, it can also extend axially across the base chamber 32, depending upon the shapes of the items to be shipped and protected.

Figure 7:
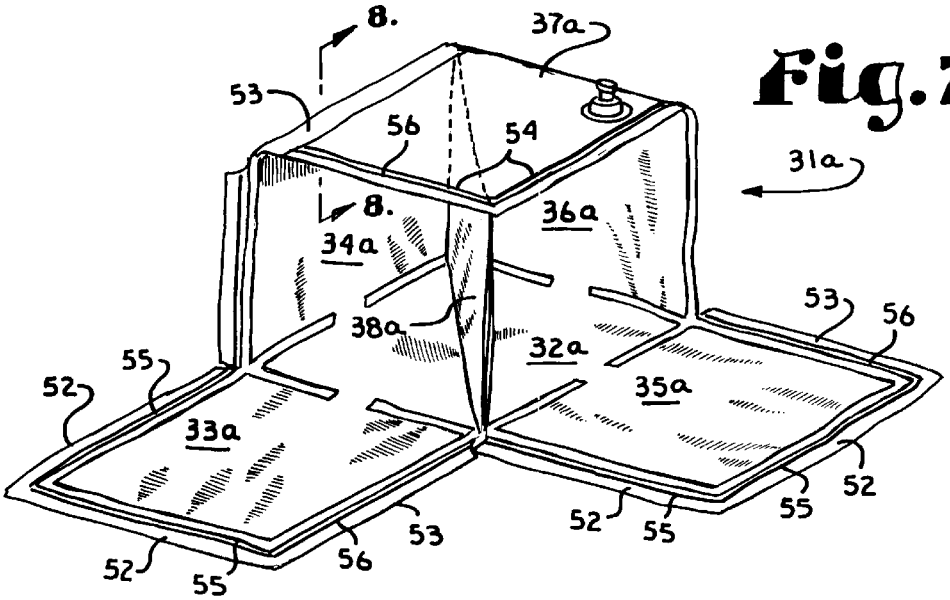
FIG. 7 is a perspective view of an inflatable protective lining system similar to that of FIG. 5, but equipped with interlocking edges on the inflatable chambers, and shown deflated with some of the chambers folded.
Figure 9:
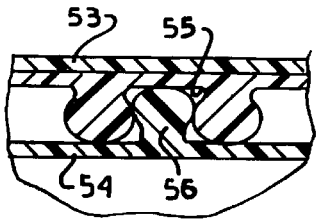
FIG. 9 is a greatly enlarged, fragmentary cross-sectional view of the highlighted portion of FIG. 8 marked "9", illustrating details of the interlocking tongue and groove.
Figure 8:
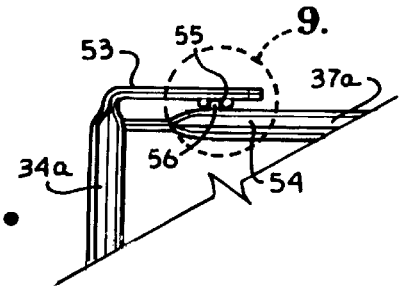
FIG. 8 is an enlarged, fragmentary, cross-sectional view of a portion of the inflatable protective lining system of FIG. 7, taken along line 8—8 of FIG. 7, and showing an interlocking tongue and groove interconnection system.

Referring to FIGS. 7–9, a third embodiment of inflatable protective lining system is illustrated and generally designated as 31*a* since it is a variation of the lining system 31 of FIGS. 5 and 6. The lining system 31*a* includes an inflatable base chamber 32*a*, side chambers 33*a*–36*a*, a top chamber 37*a* and a separating inflatable chamber 38*a*.

The lining system 31*a* incorporates an optional tongue and groove interconnection system, generally indicated at 51. With the interconnection system 51, side edges of each of side chambers 31*a*–36*a* are provided with respective extension portions 52 and 53. In addition, top edges of each of the side chambers 33*a*–36*a* are provided with extension portions 52. Finally, each free edge of top chamber 37*a* is provided with a respective flap receiving portion 54. Each extension portion 52 incorporates a resilient elongate groove 55 while each extension portion 53 and each flap receiving portion 54 incorporates a resilient tongue 56. The grooves 55 are sized to receive a respective one of the tongues 56 in an interlocking arrangement, as is shown in FIGS. 8 and 9, such that, when the lining system 1 is folded together, as shown in FIG. 7, each the tongues 56 in the extension portions 53 can be interlocked with a mating one of the grooves 55. With the inventive interlocking tongue and groove interconnection system 51, the overlapping and interlocked chambers 33*a*–37*a* form an airtight enclosure in addition to a protective liner. It is contemplated that the lining system 31*a,* thus interlocked and inflated around an article, could be Gamma irradiated to sterilize the lining system 31*a* and the enclosed article (not shown).

Figure 10:
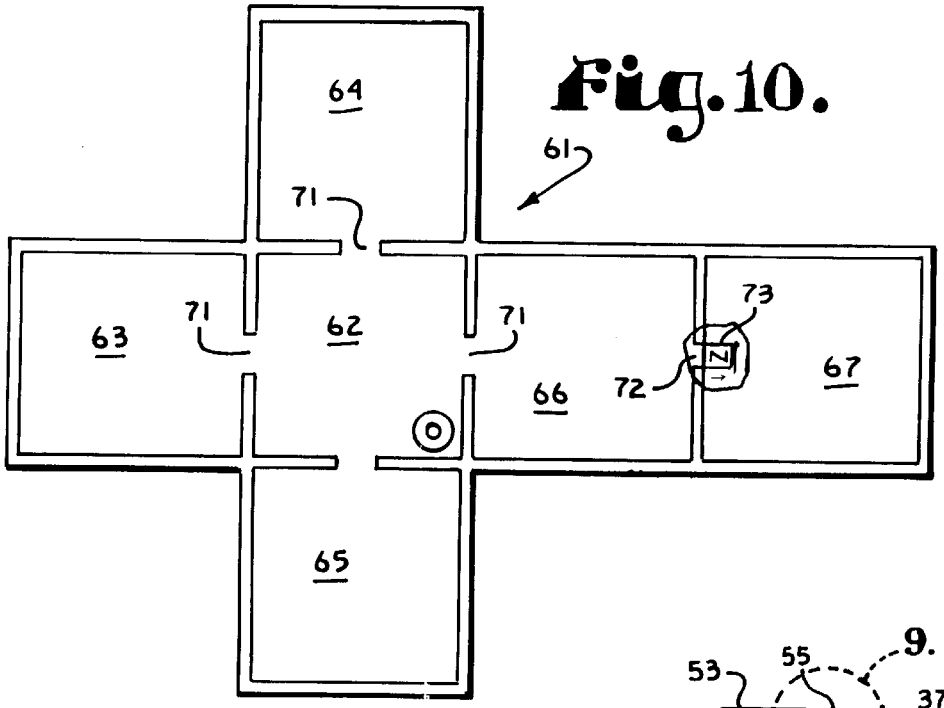
FIG. 10 is a top plan view of a third embodiment of inflatable protective lining system including a pressure sensitive check valve positioned between two of the chambers such that the pressure in one of the chambers is controlled during inflation.

Referring to FIG. 10, a fourth embodiment of inflatable protective lining system is illustrated and generally indicated at 61. The lining system 61, like the systems 1 and 31, has a base chamber 62, four side chambers 63–66 and a top chamber 67 with the base chamber 62 attached to a respective edge of each of the side chambers 63–66 and the top chamber 67 connected to an opposite edge of the side chamber 66. The base chamber 62 and the side chambers 63–66 are also interconnected via a respective plurality of air passages 71. The top chamber 67 is interconnected to the side chamber 66 via an air passage 72 within which is placed a pressure sensitive limiting valve 73. The valve 73 permits air to flow from the side chamber 66 into the top chamber 67 until such time as the top chamber 67 is inflated to a predetermined pressure, e.g. from 0.5 to 2 lbs/sq. in. Once the top chamber is so inflated, the valve 73 automatically closes, thus stopping any further air flow into the top chamber 67. Meanwhile the base chamber 62 and the side chambers 63–66 can be further inflated to any desired pressure. The valve 73 thus insures that the top chamber 67 is not overinflated, thus providing a degree of protection for the article being shipped since downward pressure from the top chamber 67 is limited to the predetermined pressure limit. Furthermore, the valve 73 insures that the top chamber 67 remains inflated, even if a puncture or other failure occurs in one of the chambers 62–66, thus providing some residual cushioning effect for the protected article (not shown). The valve 73 is a pinch release type such that the top chamber 67 can be deflated by pinching the valve 73.

Various materials can be used in the construction of the lining systems 1, 31, 31*a* and 61, including, without limitation, poly-ethylene vinyl acetate, polyethylene, polyester propylene, polyvinyl chloride, polypropylene and mylar. Wall thicknesses of the inflatable chambers can range from 0.5 mils upward to 20 mils or greater, with a preferred thickness of about 6 mils. In addition, the entire lining system 1, 31, 31*a* or 61 can be coated on the exterior of each chamber with a coating which acts as an electro-static shield, such a carbon coating, one of which is known as Doul ESD. A lining system so coated would allow a dissipating environment to be established which would protect the contents of the liner from electro-static charges.

While the shapes of the lining systems 1, 31, 31*a,* and 61 have been shown as basically cubic or rectangular in shape, it is contemplated that triangular or other suitable shapes can be employed with less or more chambers depending upon the particular application. With a triangular base and three triangular side chambers, for example, the top chamber could be eliminated. It should also be clear that any of the disclosed features, such as the multiple valves 14–16, the pressure sensitive limiting valve 73, the separation chamber 38, and the interlocking system 51, etc. can be incorporated into any of the embodiments of protective lining systems 1, 31, 31*a* and 61. The disclosed use of the inventive lining system 1 for protection of a Christmas ornament should not in any way be considered limiting. The list of other potential articles to be protected is virtually endless, but includes items as diverse as ostrich eggs, dental work, artificial hearts, fragile collectibles, etc.

It is thus to be understood that while certain forms of the present invention have been illustrated and described herein, it is not to be limited to the specific forms or arrangement of parts described and shown.

What is claimed and desired to be secured by Letters Patent is as follows:

1. An inflatable protective lining system for at least partially enclosing and protecting at least one article, said system comprising:

a. a double wall base chamber with a plurality of perimeter edges;

b. a plurality of double wall side chambers, each of which has one perimeter edge attached to a respective one of said base chamber edges, said side chambers being foldable at their attached edges with respect to said base chamber to form an enclosure for said at least one article;

c. a double wall top chamber with one edge attached to a corresponding edge of one of said side chambers, said top chamber being foldable with respect to said one side chamber to form a top of said enclosure;

d. a valve extending through a wall of one of said base or side chambers to allow interconnected ones of the base, top and side chambers to be inflated; and e. said side chambers and said top chamber each include portions of an interlocking system such that said side chambers and said top chamber can be interlocked to form said enclosure, said interlocking system comprising a tongue and groove system in which elongate tongues are formed along certain unattached edges of said side and top chambers and mating grooves are formed along other, unattached, overlapping edges of said side and top chambers such that said side and top chambers can be interlocked to form a closed container.

2. An inflatable protective lining system as in claim 1, wherein said base chamber and all of said side chambers are interconnected via respective air passages such that said base and said side chambers can be simultaneously inflated from said valve.

3. An inflatable protective lining system as in claim 1, wherein said base chamber, said side chambers and said top chamber are interconnected via respective air passages such that said base, side and top chambers can be simultaneously inflated from said valve.

4. An inflatable protective lining system as in claim 1, and further comprising:

a. a double wall separation chamber with one edge attached to said base chamber such that said separation chamber extends vertically to separate said enclosure into two separate sections.

5. An inflatable protective lining system as in claim 4, wherein said base chamber and said separation chambers are interconnected via a respective air passage such that said base and separation chambers can be simultaneously inflated from said valve.

6. An inflatable protective lining system as in claim 1, wherein said chambers comprise an electro-static shielding material such that said enclosure is a charge dissipating environment.

7. An inflatable protective lining system for at least partially enclosing and protecting at least one article, said system comprising:

a. a double wall base chamber with a plurality of perimeter edges;

b. a plurality of double wall side chambers, each of which has one perimeter edge attached to a respective one of said base chamber edges, said side chambers being foldable at their attached edges with respect to said base chamber to form an enclosure for said at least one article;

c. a double wall top chamber with one edge attached to one of said side chambers, said top chamber being foldable with respect to said one side chamber to form a top of said enclosure;

d. a double wall separation chamber with one edge attached to said base chamber such that said separation chamber extends vertically to separate said enclosure into two separate sections; and e. a valve extending through a wall of at least one of said base, top, separation or side chambers to allow interconnected ones of the base, top, separation and side chambers to be inflated.

8. An inflatable protective lining system as in claim 7, wherein said valve includes an elongate tube which allows the respective chamber or chambers to be filled remotely.

9. An inflatable protective lining system as in claim 7 wherein said side chambers and said top chamber each include portions of an interlocking system such that said side chambers and said top chamber can be interlocked to form said enclosure.

10. An inflatable protective lining system as in claim 9 wherein said interlocking system is a tongue and groove system in which elongate tongues are formed along certain edges of said side and top chambers and mating grooves are formed along other, overlapping edges of said side and top chambers.

11. An inflatable protective lining system as in claim 7, wherein said base, top and side chambers comprise an electro-static shielding material such that said enclosure is a charge dissipating environment.

* * * * *